US008803929B2

(12) United States Patent
Cok

(10) Patent No.: US 8,803,929 B2
(45) **Date of Patent: *Aug. 12, 2014**

(54) DISPLAY PIXELS WITH ALTERNATING COLORS

(75) Inventor: Ronald Steven Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 254 days.

This patent is subject to a terminal disclaimer.

(21) Appl. No.: 13/413,935

(22) Filed: Mar. 7, 2012

(65) Prior Publication Data

US 2013/0235094 A1 Sep. 12, 2013

(51) Int. Cl.
*G09G 5/02* (2006.01)
*G09G 5/10* (2006.01)

(52) U.S. Cl.
USPC ..... 345/694; 345/695; 345/613

(58) Field of Classification Search
CPC ..... G09G 3/3607; G09G 3/2003
USPC ..... 345/694, 695, 613
See application file for complete search history.

(56) References Cited

U.S. PATENT DOCUMENTS

| | | | | |
|---|---|---|---|---|
| 7,483,095 | B2 | 1/2009 | Roth et al. | |
| 7,495,722 | B2 | 2/2009 | Roth et al. | |
| 2008/0030660 | A1 * | 2/2008 | Roth et al. | 349/106 |
| 2008/0231577 | A1 * | 9/2008 | Lin et al. | 345/90 |
| 2010/0207969 | A1 * | 8/2010 | Ueki et al. | 345/694 |
| 2011/0037929 | A1 * | 2/2011 | Roth et al. | 349/106 |
| 2013/0235095 | A1 * | 9/2013 | Cok | 345/694 |

* cited by examiner

*Primary Examiner* — Aneeta Yodichkas
(74) *Attorney, Agent, or Firm* — Raymond L. Owens

(57) ABSTRACT

A display includes a substrate, a plurality of pixels located on the substrate, each pixel including only three light-emitting sub-pixels that each emit light of a different non-white color, the plurality of pixels including a first sub-set of first pixels and a second sub-set of second pixels, the second pixels having locations alternating with the first pixels, each of the first and second pixels including at least one first sub-pixel emitting light of a common first color, and the second pixels including at least one different sub-pixel emitting light of a different color that is not emitted by any sub-pixel of the first pixels, and wherein the light emitted by the sub-pixels of the first pixels defines a full-color gamut, and the light emitted by the sub-pixels of the second pixels defines less than a full-color gamut.

22 Claims, 13 Drawing Sheets

DISPLAY PIXELS WITH ALTERNATING COLORS

CROSS REFERENCE TO RELATED APPLICATION

Reference is made to commonly assigned U.S. patent application Ser. No. 13/413,954 filed Mar. 7, 2011, entitled "Method for Controlling Display With Alternating Color Pixels" by Ronald Steven Cok, the disclosure of which is incorporated herein.

FIELD OF THE INVENTION

The present invention relates to pixel structures used in high-resolution color displays.

BACKGROUND OF THE INVENTION

Display devices that render image, graphic, and textual information are widespread. Such devices are found in hand-held, portable, and fixed-location electronic devices such as mobile smart-phones, laptop computers, computer monitors, and televisions. Such displays typically include an array of light-emitting (or light-reflecting) elements formed on a substrate to represent information controlled by an electronic controller. Color displays include light-emitting elements organized into multi-color pixels. Each multi-color pixel includes multiple, single-color sub-pixels that each emit or reflect a different color of light. A typical pixel in a multi-color emissive display has a red light-emitting sub-pixel, a green light-emitting sub-pixel, and a blue light-emitting sub-pixel. The pixels are usually arranged in a two-dimensional array. The three colors define a full-color gamut for the color display.

Referring to prior-art FIG. 10, a flat-panel color display system 1 includes a controller 41 receiving an image signal 42 that is rendered by the controller 41 into an output display signal 45 for controlling a display 5 formed on a substrate 8. An array of pixels 11, each having a red light-emitting sub-pixel 50, a green light-emitting sub-pixel 52, and a blue light-emitting sub-pixel 54 is formed on the substrate 8. Thin-film transistor circuits 9 control the sub-pixels 50, 52, 54 in response to the display signal 45 from the controller 41. A variety of flat-panel light-emitting color displays 5 are known in the art, for example liquid crystal displays (LCDs), inorganic light-emitting diodes (LEDs), organic light-emitting diode displays (OLEDs), and plasma displays. Reflective displays are also known, for example reflective LCDs, and electro-phoretic displays, as are projected displays.

Display characteristics include brightness, resolution, a high fill factor, and color gamut. The brightness of a light-emitting display is limited in part by the amount of power that is converted to emitted light. The resolution of a light-emitting display is limited by the size of the light-emitting elements on the substrate. The fill factor specifies the percentage of the substrate area that is used to emit or reflect light and can influence the efficiency and life-time of the display. The color gamut is determined by the saturation of the emitted colors. A desirable light-emitting flat-panel display has high brightness, high resolution, high efficiency, a large fill factor, and a large color gamut. For low-resolution displays, a large fill factor is desirable to avoid perceptible dark areas in the display. Therefore, color displays with a large fill factor and small pixels capable of efficiently transforming electrical power into highly saturated colors are desirable.

In order to increase the color gamut of a color display, pixels with more than three colors of light-emitting sub-pixels have been proposed. For example, as shown in FIG. 11, an extended-color-gamut pixel 18 includes a red light-emitting sub-pixel 50, a green light-emitting sub-pixel 52, a blue light-emitting sub-pixel 54, a yellow light-emitting sub-pixel 56, and a cyan light-emitting sub-pixel 58. As illustrated in FIG. 12, U.S. Pat. No. 7,483,095 entitled "Multi-Primary Liquid Crystal Display" discloses a display with pixels that each include eight sub-pixels emitting light of five different colors. Three of the colors are repeated twice. Referring to FIG. 12, the extended-color-gamut pixel 18 includes red light-emitting sub-pixels 50, green light-emitting sub-pixels 52, blue light-emitting sub-pixel 54, yellow light-emitting sub-pixels 56, and cyan light-emitting sub-pixel 58.

Furthermore, because the human vision system perceives luminance signals at a higher spatial resolution than color signals, some color light-emitting sub-pixels can be present at a lower spatial resolution. For example, U.S. Pat. No. 7,495,722 entitled "Multi-Color Liquid Crystal Display" discloses a display with four-color light-emitting pixels emitting red, green, blue, and yellow light alternating with four-color light-emitting pixels emitting cyan, red, green, and blue light, as illustrated in FIG. 13. Referring to FIG. 13, a first extended-color-gamut pixel 18A includes a red light-emitting sub-pixel 50, a green light-emitting sub-pixel 52, a blue light-emitting sub-pixel 54, and a yellow light-emitting sub-pixel 56. A second extended-color-gamut pixel 18B includes a red light-emitting sub-pixel 50, a green light-emitting sub-pixel 52, a blue light-emitting sub-pixel 54, and a cyan light-emitting sub-pixel 58.

Each sub-pixel 50, 52, 54, 56, 58 and associated thin-film transistor circuits 9 (FIG. 10) occupy some portion of the substrate 8. Thus, such extended-color-gamut pixels 18 require a larger substrate area. This increase in area reduces the resolution of the display. Alternatively, the light-emitting area (fill factor) of the sub-pixels is reduced, consequently reducing the lifetime or brightness of the display. (For example the lifetime of OLED materials varies inversely with the emitting area of the materials for a given light output.) The efficiency of the light emitters can also be reduced when the area of a light-emitter is reduced at a given brightness because the power density is increased.

There is a need, therefore, for an improved color display device that improves efficiency, color gamut, and resolution.

SUMMARY OF THE INVENTION

In accordance with the present invention, a display, comprises:

a substrate;

a plurality of pixels located on the substrate, each pixel including only three light-emitting sub-pixels that each emit light of a different non-white color, the plurality of pixels including a first sub-set of first pixels and a second sub-set of second pixels, the second pixels having locations alternating with the first pixels, each of the first and second pixels including at least one first sub-pixel emitting light of a common first color, and the second pixels including at least one different sub-pixel emitting light of a different color that is not emitted by any sub-pixel of the first pixels; and wherein the light emitted by the sub-pixels of the first pixels define a full-color gamut, and the light emitted by the sub-pixels of the second pixels define less than a full-color gamut.

The present invention provides an improved display device that improves efficiency, color gamut, and resolution. The present invention further enables these attributes without increasing manufacturing costs.

These, and other, attributes of the present invention will be better appreciated and understood when considered in conjunction with the following description and the accompanying drawings. It should be understood, however, that the following description, although indicating embodiments of the present invention and numerous specific details thereof, is given by way of illustration and not of limitation. For example, the summary descriptions above are not meant to describe individual separate embodiments whose elements are not interchangeable. Many of the elements described as related to a particular embodiment can be used together with, and interchanged with, elements of other described embodiments. The figures below are not intended to be drawn to any precise scale with respect to relative size, angular relationship, or relative position or to any combinational relationship with respect to interchangeability, substitution, or representation of an actual implementation.

BRIEF DESCRIPTION OF THE DRAWINGS

The above and other features and advantages of the present invention will become more apparent when taken in conjunction with the following description and drawings wherein identical reference numerals have been used to designate identical features that are common to the figures, and wherein.

DETAILED DESCRIPTION OF THE INVENTION

Figure 1:
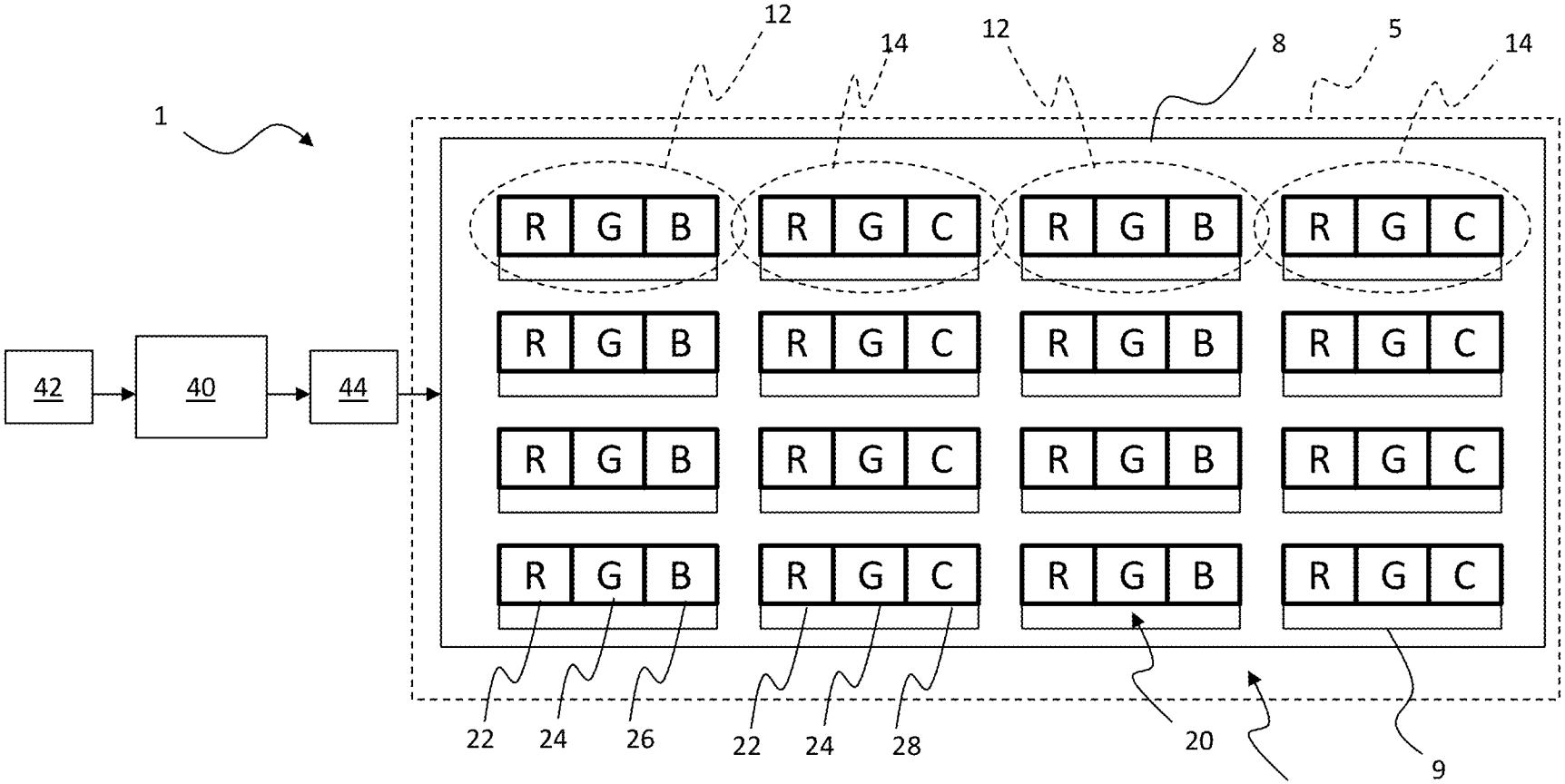
FIG. 1 is a schematic illustrating an embodiment of the present invention.

Display devices are typically designed with a preferred designed viewing distance. This viewing distance is sometimes expressed as a multiple of the height of the display screen with a viewing distance of two to three times the screen height preferred. Common viewing distance ranges are 25 to 40 cm for a hand-held display device, 40 cm to 80 cm for a desktop display device such as a computer monitor, and 1 to 4 meters for a household television.

Preferably, a display system will have a high resolution, so that individual pixels cannot be resolved on the display at the designed viewing distance. Thus, the preferred resolution for a display will increase as the viewing distance for the display decreases. A display whose pixels cannot be resolved by the human visual system is called an "eye-limited display" herein. An eye-limited hand-held display can be challenging to construct since the designed viewing distance for a hand-held device is relatively small compared to other displays, for example 300 pixels per inch or greater than 118 pixels per centimeter. The resolution at the sub-pixel level is accordingly increased by a factor corresponding to the number of sub-pixels in the pixel. Pixels in an eye-limited display are smaller than those in a corresponding display that is not eye-limited. Thus, the design rules for the pixels and supporting circuitry formed on a substrate with the pixels are smaller and more difficult to achieve, resulting in displays that have more expensive manufacturing equipment, lower yields, and higher costs.

As is known in the prior art, the human visual system can perceive a higher resolution for luminance signals than for color signals. Since green is a larger component of a luminance signal than red or, especially, blue, a display with a greater number of green sub-pixels than red or blue will have a higher perceived resolution. Furthermore, the human visual system is less responsive to red light and, especially, blue light so that sub-pixels with a greater light emission in red and blue are required to provide an equivalent perceived brightness compared to green light emission. Thus, it is more efficient to produce unsaturated colors (e.g. white) with colors other than red or blue, for example cyan or yellow, to which the human eye is more sensitive. It is also the case that for some display technologies, it is less efficient to produce blue or red light than it is to produce cyan, yellow, or, especially, green light. For example, the efficiency of green OLED light-emitters is much higher than the efficiency of red OLED light emitters, which are in turn more efficient than blue OLED light emitters. Likewise, blue inorganic LEDs are less efficient than green or red inorganic LEDs. As used herein and as is customarily understood in the art, colors can be approximate, so that a red color is substantially red, a green color is substantially green, a blue color is substantially blue, a yellow color is substantially yellow, and a cyan color is substantially cyan, even though examples of a particular color can have slightly different color coordinates.

In addition to resolution, the color gamut and the efficiency are important attributes of a color display. The color gamut determines the range of colors that the color display can reproduce and the efficiency determines how much power is needed to control the display.

The present invention is addressed to a color display that provides a display with improved efficiency and high resolution. The color display of the present invention provides manufacturing advantages when the resolution is eye-limited. The present invention can also provided an extended color gamut.

Referring to FIG. 1, in an embodiment of the present invention a color display system 1 includes a color display 5 and a controller 40. The color display 5 includes a substrate 8 with a plurality of pixels 10 located on the substrate 8. Each pixel 10 includes only three light-emitting sub-pixels 20 that each emits light of a different non-white color. The plurality of pixels 10 includes a first sub-set of first pixels 12 and a second sub-set of second pixels 14, the second pixels 14 having locations alternating with the first pixels 12. Each of the first and second pixels 12, 14 include at least one first sub-pixel 20 emitting light of a common first color, and the second pixels 14 include at least one different sub-pixel 20 emitting light of a different color that is not emitted by any sub-pixel 20 of the first pixels 12. The light emitted by the sub-pixels 20 of the first pixels 12 defines a full-color gamut, and the light emitted by the sub-pixels 20 of the second pixels 14 defines less than a full-color gamut.

In a further embodiment of the present invention, each of the first and second pixels 12, 14 include at least one second sub-pixel 20 emitting light of a common second color different from the common first color. The first and second pixels 12, 14 can be arranged in a two-dimensional array on the substrate 8. The alternating first and second pixels 12, 14 can form interleaved sub-arrays of the two-dimensional array.

A full-color gamut includes red, green, blue, cyan, and yellow colors, as well as white. As is known in the color science art, a combination of blue and green light is perceived by viewers as cyan light, while a combination of red and green light is perceived by viewers as yellow light. In general, primary colors in an additive color system used with emitted light as is found in a color display are basic colors used to make other colors by addition or subtraction. The primary colors are generally considered to be the individual light sources, colorants or filters used in a device to produce a range of colors, called the color gamut of the device. In general, the color gamut of the device cannot reproduce the full range of colors perceptible by humans. Because of the horseshoe-shape of the spectrum locus of monochromatic light sources, it is not possible to reproduce the full gamut of perceivable colors with a reduced set of even monochromatic sources (see FIGS. 8 and 9 discussed further below). With respect to the present invention, blue, green, and red light are not formed by a perceptual combination with yellow or cyan light with adequate saturation for an acceptable color display. Thus, as used herein, red, green, and blue are primary colors and can be used to make yellow or cyan colors with adequate saturation but yellow and cyan are secondary colors that cannot be used to make red, green, or blue colors with adequate saturation.

As illustrated in the example of FIG. 1, the common first color is green and green light is emitted by the second sub-pixels 24 of both the first pixel 12 and the second pixel 14. The common second color is red and red light is emitted by the first sub-pixels 22 of both the first pixel 12 and the second pixel 14. The first pixel 12 includes a third sub-pixel 26 that emits blue light, and the different color of light emitted by a different sub-pixel 28 of the second pixel 14 is cyan.

Figure 2:
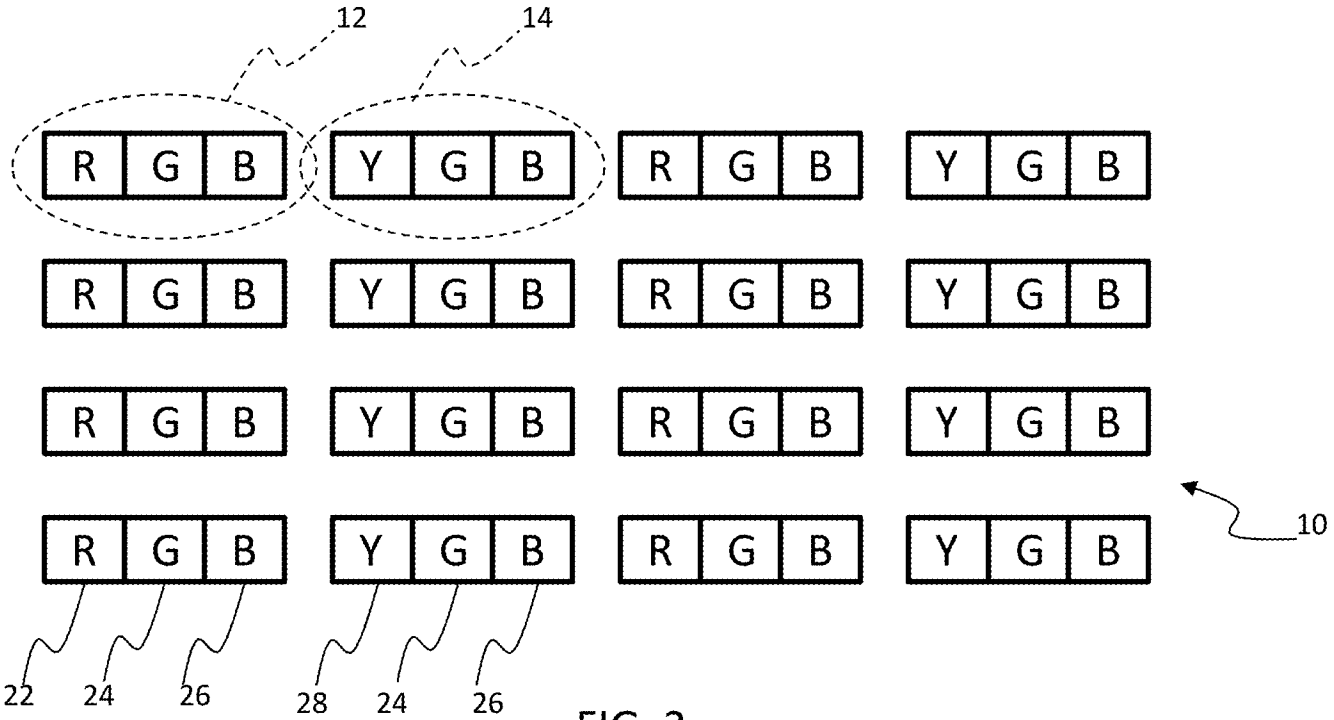
FIG. 2 is a schematic illustrating a pixel array useful in an another embodiment of the present invention.

In an alternative embodiment illustrated in FIG. 2, the common first color is green and green light is emitted by the second sub-pixels 24 of both the first pixel 12 and the second pixel 14. The common second color is blue and blue light is emitted by the third sub-pixels 26 of both the first pixel 12 and the second pixel 14. The first pixel 12 includes the first sub-pixel 22 that emits red light, and the different color of light emitted by the different sub-pixel 28 of the second pixel 14 is yellow.

Figure 3:
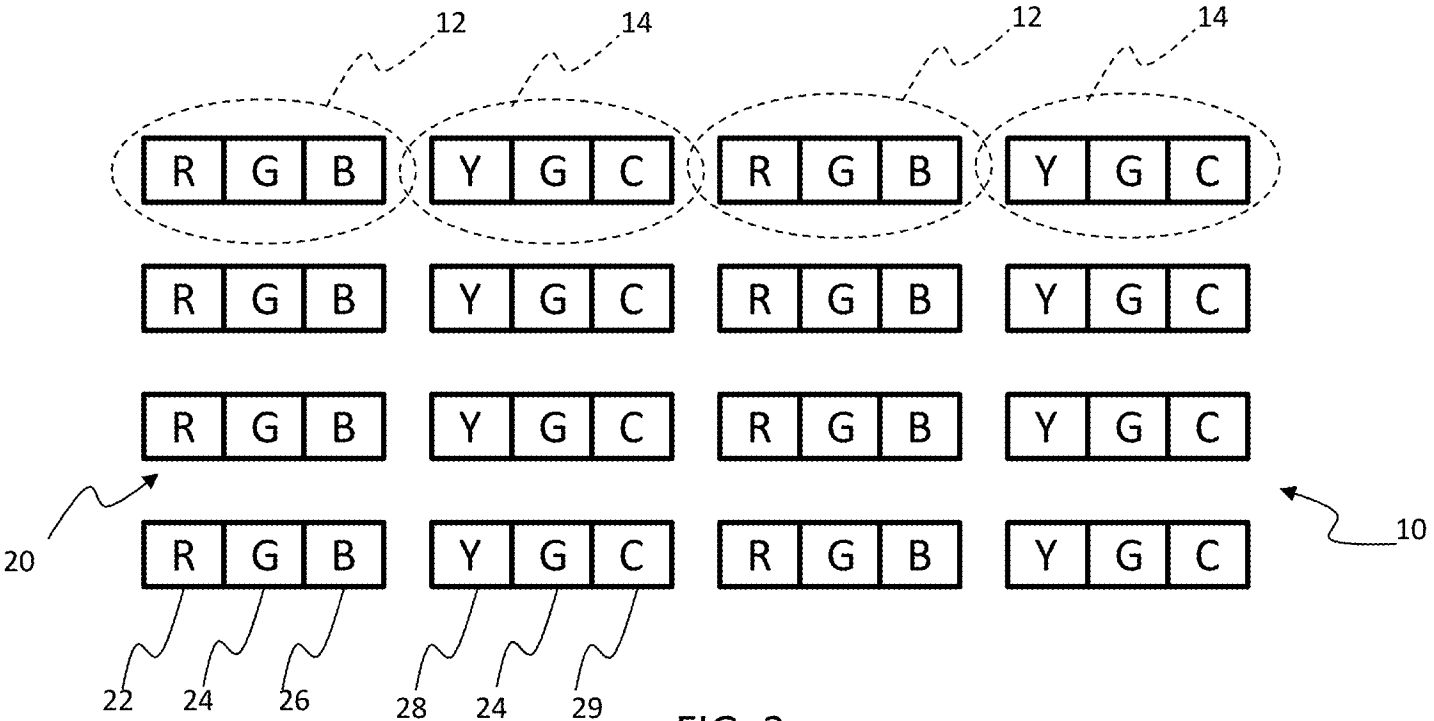
FIG. 3 is a schematic illustrating another pixel array useful in an alternative embodiment of the present invention.

In another embodiment illustrated in FIG. 3, the second pixels 14 include a second different sub-pixel 29 that emits light of a second different color that is not emitted by any sub-pixel 20 of the first pixels 12. As illustrated, the common first color is green and green light is emitted by the second sub-pixels 24 of both the first pixel 12 and the second pixel 14. The second pixel 14 includes the different sub-pixel 28 that emits the different color of light, yellow light. The second different sub-pixel 29 of the second pixel 14 emits second different color light that is cyan. Thus, as illustrated in FIG. 3, the first pixel 12 includes sub-pixels 20 that emit red, green, and blue light, and the second pixel 14 includes sub-pixels 20 that emit yellow, green, and cyan light.

Figure 4:
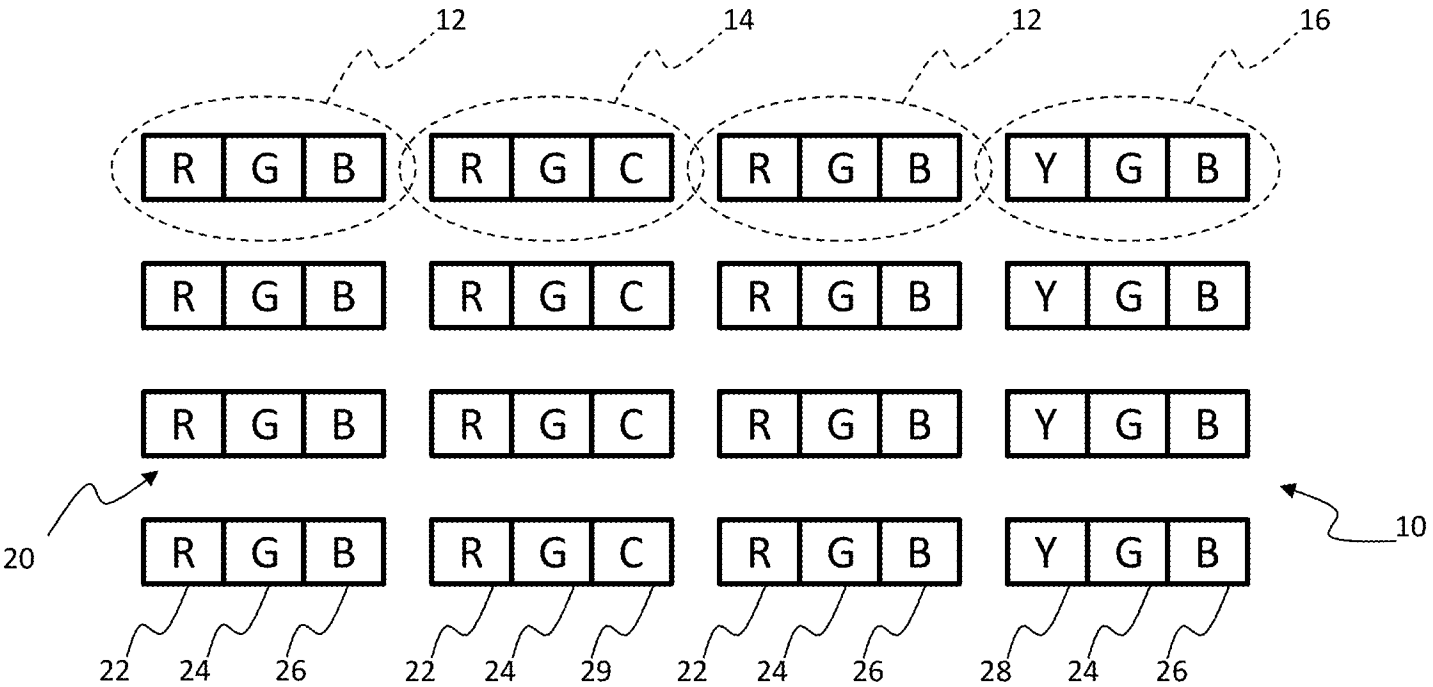
FIG. 4 is a schematic illustrating yet another pixel array useful in another embodiment of the present invention.

Referring to FIG. 4, in another embodiment of the present invention, the plurality of pixels 10 includes a third sub-set of third pixels 16 having locations alternating with the first and second pixels 12, 14. Each of the first, second, and third sub-pixels, 12, 14, 16 include at least one sub-pixel 20 that emits light of the common first color. The third pixel 16 includes a different sub-pixel 28 that emits light of a different color that is not emitted by any of the sub-pixels 20 of either the first or second pixels 12, 14. The second sub-pixel 14 includes a second different sub-pixel 29 that emits light of a second different color that is not emitted by any of the sub-pixels of either the first or third pixels 12, 16.

In a further embodiment of the present invention, also illustrated in FIG. 4, each of the first and second pixels 12, 14 include at least one sub-pixel 20 emitting light of a common second color different from the common first color and each of the first and third pixels 12, 16 include at least one sub-pixel 20 emitting light of a common third color different from the common first color and different from the common second color.

As illustrated in the example embodiment of FIG. 4, the common first color is green and green light is emitted by the second sub-pixel 24 of the first pixel 12, the second pixel 14, and the third pixel 16. The common second color is red, and red light is emitted by the first sub-pixel 22 of both the first pixel 12 and the second pixel 14. The common third color is blue and blue light is emitted by the third sub-pixel 26 of both the first pixel 12 and the third pixel 16. The second different color is cyan and cyan light is emitted by the second different sub-pixel 29 of the second pixel 14. The different color is yellow and yellow light is emitted by the different sub-pixel 28 of the third pixel 16. Thus, first and second pixels 12, 14 both include the first sub-pixel 22 that emits red light and the second sub-pixel 24 that emits green light. First and third pixels 12, 16 both include the second sub-pixel 24 that emits green light and the third sub-pixel 26 that emits blue light.

Referring back to the embodiment of FIG. 1, the first pixel 12 includes the first sub-pixel 22 that emits a color of light (red) that is complementary to the color of light (cyan) emitted by the different sub-pixel 28 of the second pixel 14. As shown in FIG. 2, the first pixel 12 includes the third sub-pixel 26 that emits a color of light (blue) that is complementary to the color of light (yellow) emitted by the different sub-pixel 28 of the second pixel 14. As shown in FIG. 3, the first pixel 12 includes the third sub-pixel 26 that emits a color of light (blue) that is complementary to the color of light (yellow) emitted by the different sub-pixel 28 of the second pixel 14 and the first pixel 12 includes the first sub-pixel 22 that emits a color of light (red) that is complementary to the color of light (cyan) emitted by the second different sub-pixel 29 of the second pixel 14.

In the embodiment of FIG. 4, the first pixel 12 includes the first sub-pixel 22 that emits a color of light (red) that is complementary to the different color of light (cyan) emitted by the second different sub-pixel 29 of the second pixel 14. The first pixel 12 also includes the third sub-pixel 26 that emits a color of light (blue) that is complementary to the different color of light (yellow) emitted by the different sub-pixel 28 of the third pixel 16.

As illustrated in FIGS. 1-4, in an embodiment of the present invention, the plurality of pixels 10 forms a two-dimensional array of pixels 10, for example, forming rows and columns of pixels 10. The first pixels 12 can alternate with the second pixels 14 in the rows, as shown, or in the columns (not shown) or both (not shown) so that every other pixel 10 in one or both dimensions of the array of pixels 10 is a first pixel 12 and the remaining pixels 10 are second pixels 14. Alternatively, every fourth pixel 10 in one or both dimensions of the array is a second pixel 14 and the remaining pixels 10 are first pixels 12 (not shown). As illustrated in FIG. 4, every other pixel 10 in a row is a first pixel 12, every fourth pixel in the row is a second pixel 14, and every fourth pixel in the row is a third pixel 16. This arrangement can also be employed in columns (not shown) or in both rows and columns. Various arrangements of pixels 10 in rows and columns are well known in the display art. While the pixels 10 illustrated in FIGS. 1-4 are shown in stripe format, the present invention includes other formats, for example in which different rows (or columns) of pixels 10 are offset with respect to each other, pixels 10 are formed in columns, or individual pixels 10 are formed in more than one row or column, for example in a triangular arrangement. In these Figures, the sub-pixels 20 are shown spatially grouped into pixels 10 for clarity of illustration. However, as is known in the prior art, adjacent sub-pixels 20 from adjacent pixels 10 can be located as close together on the substrate 8 as adjacent sub-pixels 20 in a pixel 10 in either the row or column direction, depending on the desired layout of the sub-pixels 20, pixels 10, and supporting structures on the substrate 8.

Manufacturing processes for making pixels on a substrate are well known in the display arts, as are tools for design and layout for pixels and sub-pixels in various arrangements, including those described herein. Such tools are used to design masks used to form color filters on substrates, or for the deposition of light-emitting material over a substrate area, or to form cavities for containing light-emitting plasma gases and are well known in the art.

Sub-pixels can be self-emissive, for example with organic light-emitting diode displays or plasma displays. Displays can include a backlight together with light switches and color filters to control light output, for example with liquid crystal displays. Circuit designs for controlling sub-pixels in flat-panel displays are well-known, for example with passive-matrix controllers and active-matrix controllers. Thin-film conductors, resistors capacitors, and transistors formed on substrates are also well known in the art and can be manufactured to control the sub-pixels of the present invention. Reflective substrates can also be employed, for example using ambient light together with reflective liquid crystal displays and color filters, electro-phoretic displays, or projectors.

Pixels 10 or sub-pixels 20 of the present invention can have different sizes or shapes to facilitate layout on the substrate 8, for example in the flat-screen color display 5. The different sizes or shapes can be chosen, for example, to improve the relative lifetime of the sub-pixels or to improve the perceived color display resolution. Thus, in an embodiment, at least one sub-pixel 20 of at least one pixel 10 of the plurality of pixels 10 is a different size or shape than another sub-pixel 20 of the one pixel 10 or another of the plurality of pixels 10.

According to further embodiments of the present invention, the different color is within the full-color gamut defined by the light output from the sub-pixels 20 of the first pixels 12. In this embodiment, the different color does not expand the color gamut that can be reproduced by the color display 5. For example, referring to FIG. 4, the color of cyan light emitted by the second different sub-pixel 29 of second pixel 14 can be reproduced by a combination of the blue and green light emitted by the red, blue, and green first, second, and third sub-pixels 22, 24, 26 of first pixel 12 and the color of yellow light emitted by different sub-pixel 28 of third pixel 16 can be reproduced by a combination of the red, green, and blue light emitted by the red, green, and blue first, second, and third sub-pixels 22, 24, 26 of first pixel 12.

Figure 8:
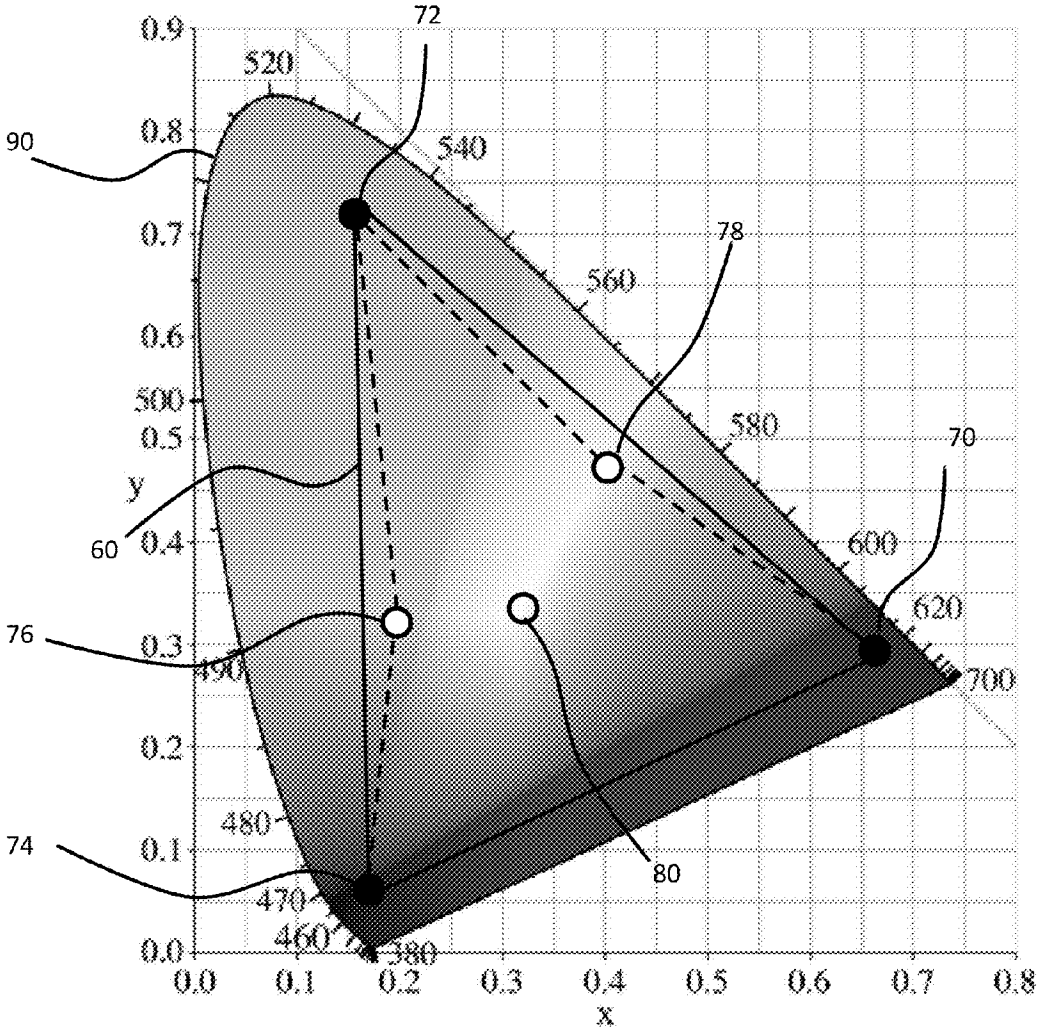
FIG. 8 is an illustration of the 1931 CIE color space useful in understanding the present invention.

Referring to FIG. 8, a CIE 1931 color-space chromaticity diagram illustrates a first color gamut 60 having red, green, and blue points 70, 72, 74. The area enclosed within the color gamut 60 can be reproduced by light emitters emitting light having the chromaticities indicated by the red, green, and blue points 70, 72, 74. The outer curved boundary is the locus 90 of saturated or monochromatic light, with wavelengths shown in nanometers. The addition of light emitters emitting light of the frequencies indicated by a cyan point 76 and a yellow point 78 does not extend the color gamut outside the bounds of color gamut 60. Thus, in this embodiment, the additional cyan and yellow colors do not increase the range of colors that can be reproduced.

According to another embodiment of the present invention, the different color is not within the full-color gamut defined by the light output from the sub-pixels 20 of the first pixels 12. In this embodiment, the different color expands the color gamut that can be reproduced by the color display 5. For example, referring to FIG. 4, the color of cyan light emitted by second different sub-pixel 29 of second pixel 14 cannot be reproduced by a combination of the red, green, and blue light emitted by the red, green, and blue first, second, and third sub-pixels 22, 24, 26 of first pixel 12. Likewise, the color of yellow light emitted by different sub-pixel 28 of third pixel 16 cannot be reproduced by a combination of the red, green, and blue light emitted by the red, green, and blue first, second, and third sub-pixels 22, 24, 26 of first pixel 12.

Figure 9:
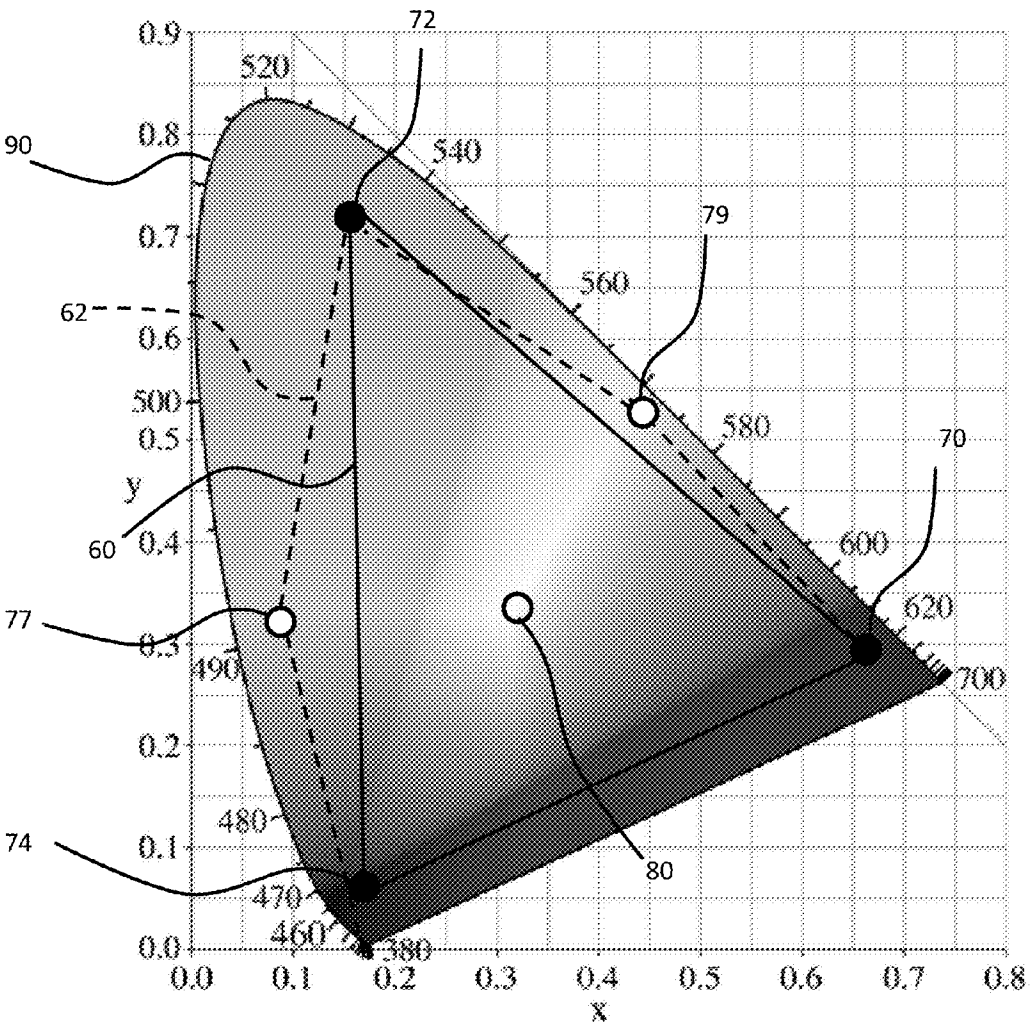
Figure 10:
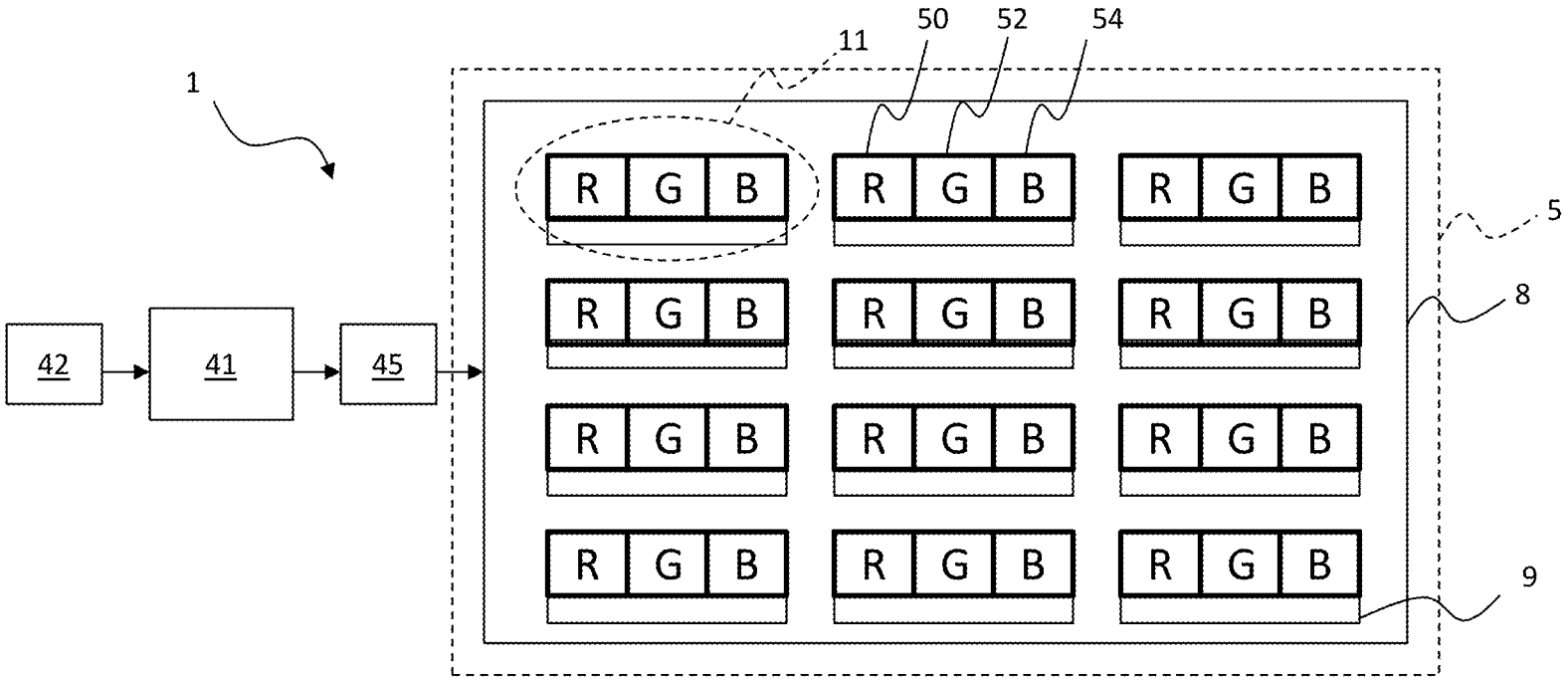
FIG. 10 Prior Art
FIG. 10 is a schematic illustrating a prior-art display system.
Figure 11:
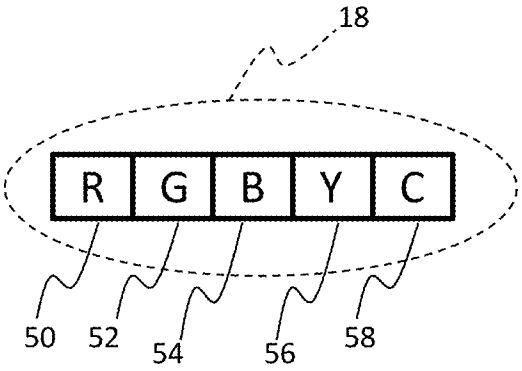
FIG. 11 Prior Art
FIG. 11 is a schematic illustrating a prior-art extended-color-gamut pixel.
Figure 12:
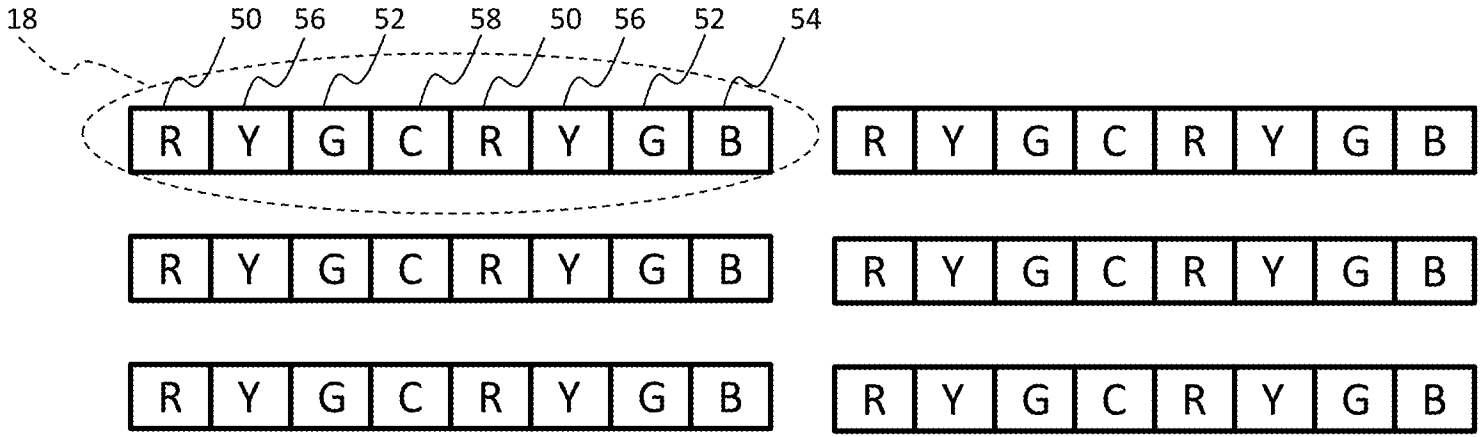
FIG. 12 Prior Art
FIG. 12 is a schematic illustrating a prior-art extended-color-gamut pixel array.
Figure 13:
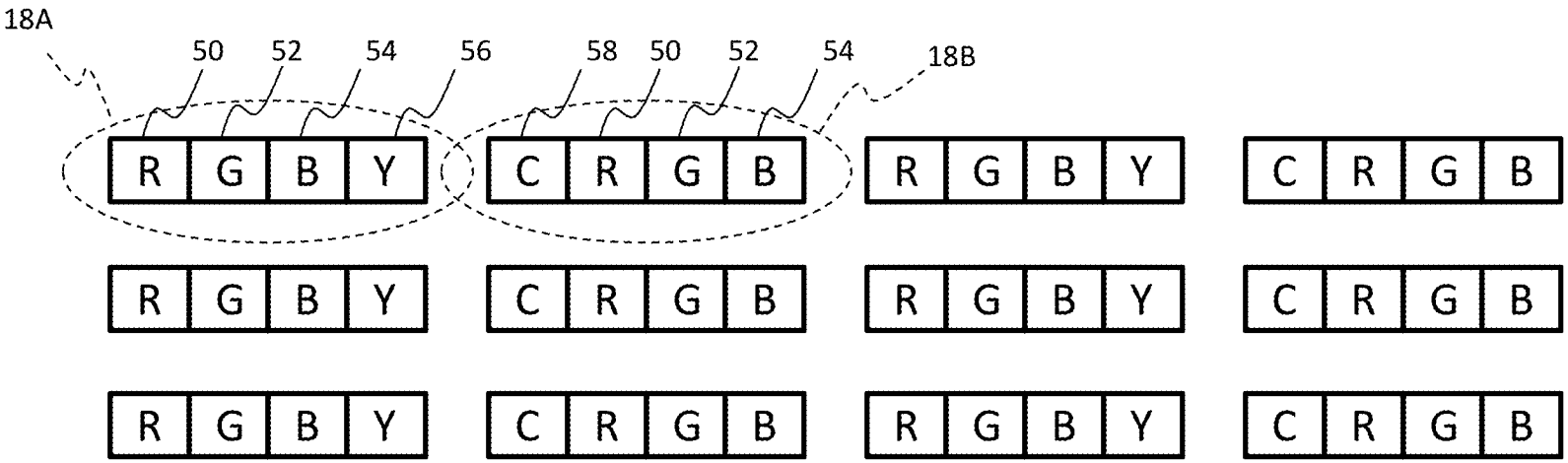
FIG. 13 Prior Art
FIG. 13 is a schematic illustrating another prior-art extended-color-gamut pixel array with alternating pixels.

Referring to FIG. 9, a CIE 1931 color-space chromaticity diagram illustrates a first color gamut 60 having red, green, and blue points 70, 72, 74. The area enclosed within the color gamut 60 can be reproduced by light emitters emitting light having the chromaticities indicated by the red, green, and blue points 70, 72, 74. The outer curved boundary is the locus 90 of saturated or monochromatic light, with wavelengths shown in nanometers. With the addition of light emitters emitting light of the frequencies indicated by the cyan point 77 and yellow point 79, the color display 5 can reproduce the colors within an extended color gamut 62. Since the area of the extended color gamut 62 is greater than, and includes, the color gamut 60, the extended color gamut 62 can reproduce a wider range of colors and provide a wider range of colors in comparison to the color display 5 having only light emitters capable of emitting the red, green, and blue colors of light.

In alternative embodiments of the present invention, one of either the cyan or yellow light-emitting sub-pixels can be within or without the color gamut defined by the light emitted by the first pixel and consequently expand the color gamut in either the yellow or cyan area (not shown). The CIE 1931 color-space chromaticity diagram and color gamuts associated with light emitters are well known in the color science art.

As noted above with reference to FIG. 3, the first pixel 12 can include the first sub-pixel 22 that emits a color of light (red) that is complementary to the color of light (cyan) emitted by the second different sub-pixel 29 of the second pixel 14 or the first sub-pixel 22 emits a color of light (blue) that is complementary to the color of light (yellow) emitted by the different sub-pixel 28 of the second pixel 14. In either case, as shown in FIGS. 8 and 9 in an embodiment of the present invention, light from the sub-pixels emitting the complementary colors is combined to form light matching a desired white point 80 for the color display 5. The desired white point 80 of the color display 5 can be on the Planckian locus (not shown). By using complementary emitters that can together reproduce a desired white point 80 for the color display 5 the complementary emitters can reproduce a white color for the color display 5. Since white is a very common color found in images shown on color displays, the complementary emitters can often be used to reproduce non-saturated colors in images.

It is an advantage of the present invention that the color display 5 can have improved efficiency without a loss of discernible resolution and without restricting the manufacturing requirements for the color display 5, with or without the expanded color gamut 62. In an embodiment of the present invention, the sub-pixel 20 of the second pixels 14 that emits light of the different color has a greater luminous efficacy than the sub-pixel 20 of the first pixels 12 that emits light that is not emitted by any of the sub-pixels 20 of the second pixels 14. For example, referring back to FIG. 1, the cyan light-emitting different sub-pixel 28 of the second pixel 14 has a greater luminous efficacy than the blue light-emitting third sub-pixel 26 of the first pixel 12. Referring back to FIG. 2, the yellow light-emitting different sub-pixel 28 of the second pixel 14 has a greater luminous efficacy than the red light-emitting first sub-pixel 22 of the first pixel 12. Referring back to FIGS. 3 and 4, the cyan light-emitting second different sub-pixel 29 of the second pixel 14 has a greater luminous efficacy than the blue light-emitting third sub-pixel 26 of the first pixel 12 or the yellow light-emitting different sub-pixel 28 of the second (FIG. 3) or third (FIG. 4) pixel 14, 16 has a greater luminous efficacy than the red light-emitting first sub-pixel 22 of the first (FIG. 3) or second (FIG. 4) pixel 12, 14.

Luminous efficacy is the ratio between the total luminous flux (perceived light lumens) emitted by a device and the total amount of input power (Watts). The luminous flux in lumens/Watt includes the luminosity function representing the response of the human eye to different wavelengths of light. The luminous efficacy of the color display 5 of the present invention is dependent upon both the efficiency (photons per watt) of a light emitter and the human-eye response (luminosity) of the produced photons.

Blue light emitters made by organic light-emitting diodes are less efficient at converting electrical current to blue light than are cyan light emitters. Thus, colors that can be made with cyan light rather than blue are more efficiently produced with the cyan light-emitting sub-pixel. Likewise, red light emitters made by organic light-emitting diodes are less efficient at converting electrical current to red light than are yellow light emitters. Thus, colors that can be made with yellow light rather than red are more efficiently produced with the yellow light-emitting sub-pixel. For example, red, green, and blue OLED emitters are known with efficiencies of 12 cd/A, 30 cd/A, and 5 cd/A while yellow emitters have an efficiency between that of red and green and cyan emitters have an efficiency between that of blue and green. The same is true for inorganic light emitting diodes, for example having 9-12 lumens/W, 35 lumens/W, and 8 lumens/W for red, green, and blue emitters respectively. Moreover, LCDs using color filters are also less efficient at producing saturated blue or red light than the complementary cyan or yellow light. Furthermore, the more saturated a primary color is, the less efficient it tends to be. For example, a deeper blue or deeper red color is less efficient to produce than a less saturated color version of the same color.

Hence, by using the present invention, more-saturated light-emitters can be used for primary colors, thereby expanding the color gamut of the color display while at the same time improving the efficiency of the color display 5 by using complementary-color light-emitters to provide light for the majority of the colors (including gray). In addition, if the complementary-color light-emitters (e.g. cyan and yellow) are outside the color gamut defined by light emitted by the first pixel 12, the color gamut of the color display 5 is further improved. Thus, an embodiment of the present invention improves efficiency while providing improved color gamut through either more saturated primary (e.g. red, blue) colors, or through the use of light emitters emitting light (cyan, yellow) outside the color gamut defined by the light emitted by the primary light emitters (red, green, blue), or both.

Furthermore, the human visual system is more responsive to colors that are closer to green on the locus of saturated light (FIGS. 8, 9 element 90). Thus, more light is required to produce a perceived brightness of a white color when the white color is produced using a blue or red light-emitter than when the white color is produced using a cyan or yellow light-emitter. Thus, using a cyan or yellow light emitter to produce a white color requires less power than using a blue or red. Hence, the present invention provides improved efficiency in reproducing a wide range of images by employing light emitters that have both improved efficiency (production of photons) and improved luminosity (improved response to photons).

Referring back to FIG. 1, according to a further embodiment of the present invention the color display 5 can further include the controller 40 having circuits connected to the sub-pixels 20 for converting the image signal 42 to a display signal 44 thereby controlling the light emitted by the sub-pixels 20 in the pixels 10 of the color display 5 to form the color display system 1. According to an embodiment of the present invention, the controller 40 converts a uniform image signal 42 into a non-uniform display signal 44. For example, the uniform image signal 40 can specify an image of a single color such as white. Image signals typically employ red, green, and blue values to express pixel colors. Therefore, the uniform image signal 42 has a uniform set of red, green, and blue values. However, when driving the sub-pixels 20 of the pixels 10 in the color display 5, the controller 40 can provide improved efficiency by using a non-uniform signal that varies between the first pixels 12 and the second pixels 14. Since, as noted above, a cyan emitter has greater luminous efficacy than the blue emitter, in the arrangement of FIG. 1 the display signal 44 specifying a zero value for blue light-emitting third sub-pixel 26 in the first pixel 12 and a greater-than-zero value for the cyan light-emitting different sub-pixel 28 in the second pixels 14 provides improved efficiency. The red and green light-emitting first and second sub-pixels 22, 24 also emit some light. By adjusting the relative light emission of the red, green, and cyan light emitting first, second and different sub-pixels 22, 24, 28 a desired white light can be emitted with greater efficiency than by using the blue light-emitting third sub-pixel 26.

Likewise, a yellow emitter has greater luminous efficacy than the red emitter. In the arrangement of FIG. 2, the display signal 44 specifying a zero value for red light-emitting first sub-pixel 22 in the first pixel 12 and a greater-than-zero value for the yellow light-emitting different sub-pixel 28 in the second pixels 14 has improved efficiency. The blue and green light-emitting third and second sub-pixels 26, 24 also emit some light. By adjusting the relative light emission of the blue, green, and yellow light emitting third, second and different sub-pixels 26, 24, 28 a desired white light can be emitted with greater efficiency than by using the red light-emitting pixel first sub-pixel 22. The embodiments of FIGS. 3 and 4 provide similar advantages.

The mathematics for controlling the color of light output from light-emitters having known CIE coordinates in a color display are known in the art. Such algorithms can be implemented in firmware or software in digital processors, for example as found in display controllers known in the art.

The present invention provides a resolution advantage combined with the efficiency advantage described. The human visual system is more responsive to higher spatial frequencies in a luminance (black and white) image signal than in a color signal (or color difference signal). Image signals can be defined in terms of a luminance signal and a color difference signal. It is known that green light is a major component of the luminance signal while red, and especially blue, carry less luminance information. According to embodiments of the present invention, a common-color light-emitting sub-pixel is present in every pixel 10 to emit light corresponding to a luminance signal for each pixel 10. Other-color light-emitters are not necessarily present in every pixel 10. The common-color light-emitting sub-pixel can emit green light. Therefore, by controlling the light-emitted by the sub-pixels 20 to provide a green color signal to every pixel 10, the luminance signal is present in every pixel 10, thereby matching the human visual system's greater sensitivity to luminance information. The color difference signal can be present in varying degrees in the first and second pixels 12, 14, depending on the colors desired and the efficiency desired. For example, cyan can replace blue and yellow can replace red as desired and depending upon the colors to be reproduced. Since the human visual response to color signals is less than that of luminance signals, the reduced resolution of the color signal in the first and second pixels 12, 14 is not as visible.

The present invention provides particular advantages when employed in the color display system 1 viewed by users at a distance from which the user cannot resolve either the luminance or color signal. Thus, the luminance signal emitted from each pixel is not resolvable by a user viewing the color display 5 and the color signal emitted from each pair of pixels is not resolvable by a user viewing the color display 5 within a desired viewing distance range. Further, in an embodiment, a luminance signal emitted from only second pixels 14 is resolvable by a user viewing the color display 5 within a desired viewing distance range.

In an embodiment, at the desired viewing distance, the color display 5 has sufficient resolution to meet the needs of the human visual system but not more. A higher resolution would not be visible to a viewer and would require more stringent manufacturing standards and therefore a higher cost. Thus, the color display 5 of the present invention reproducing a luminance signal in every pixel 10 and a color signal less than every pixel 10 (e.g. every other pixel 14) provides a useful combination of features. A higher resolution in which the color signal is fully reproduced in every pixel 10 does not provide additional value since the additional resolution is not perceptible to a viewer. A lower resolution would result in perceptible variation in either color or luminance signals in uniform image areas. Note that because color signal emitters are present in every pixel, for some color signals a higher resolution is available for the color signal with a possible efficiency reduction (e.g. combining color emitters in both the first and second pixels 12, 14). For other signals, for example a high-frequency saturated-color signal, the resolution of the signal reproduced by the color display 5 is reduced.

According to a further embodiment of the present invention referring back to FIG. 1, the color display system 1 includes the color display 5 as described above, a controller 40 for receiving the image signal 42 and converting the image signal 42 to the display signal 44 and the thin-film transistor circuit 9 associated with each pixel 10 for driving the associated pixel 10 to emit light corresponding to the display signal 42. Pixel circuits can be thin-film transistor circuits 9 or conductors known in the art and employed with controllers 40 to provide, for example, active-matrix control or passive-matrix control to the sub-pixels 20. Active- and passive-matrix controller, drive methods, thin-film conductors and circuits including passive and active elements such as resistors, capacitors, and transistors are well known in the display arts.

The present invention provides the color display system 1 with improved efficiency and resolution. The color display 5 is particularly useful for eye-limited displays whose individual pixels and sub-pixels are not resolvable by the human visual system at a designed display viewing distance. By including green sub-pixels at a relatively higher frequency than other colors, the color display 5 will appear to have a higher overall resolution. By using only three-color pixels, the number of pixels in the color display 5 and the fill factor is increased since additional space on the color display 5 substrate needed for circuits and to meet manufacturing tolerances are reduced. This increases the display resolution and the light-emitting area of the substrate, increasing brightness and lifetime of the color display 5. By using cyan or yellow sub-pixels in alternating pixels, the efficiency with which unsaturated colors are produced is increased, both because the human visual system is more responsive to those colors and because the materials used to emit cyan and yellow light are more efficient than the materials used to emit red and blue light. Furthermore, in some embodiments of the present invention, the cyan and yellow sub-pixels increase the color gamut of the color display 5. Thus, embodiments of the present invention provide a useful combination of luminance and color resolution that improves the efficiency and color gamut of the color display 5. In various embodiments, the color display 5 is an emissive, a reflective, or a projected display.

In contrast, prior-art displays with four-, five-, or six-primary-color pixels, have fewer, larger pixels and hence reduced resolution or fill factor because of the substrate area needed for the drive circuitry to control the four, five, or six sub-pixels. Furthermore, such a prior-art display can have a lower perceived resolution because relatively fewer sub-pixels that carry luminance information are present in the color display 5.

Figure 5:
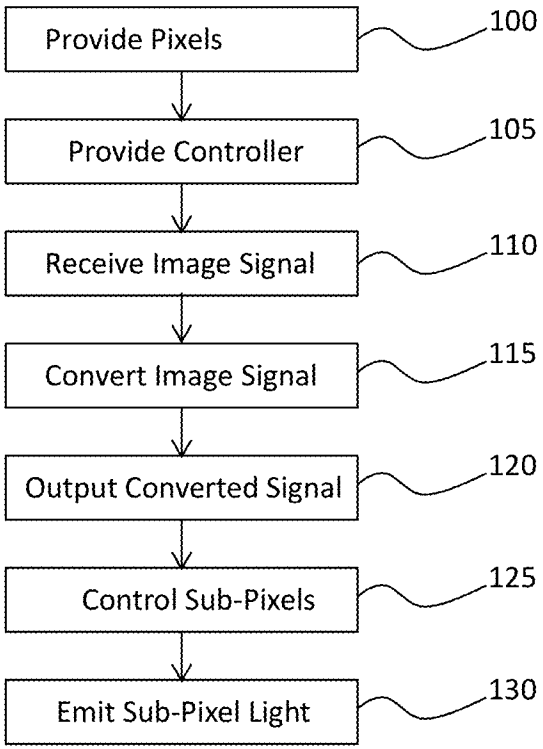
FIG. 5 is a flow diagram illustrating a method of the present invention.

Referring to FIGS. 1 and 5, in a further embodiment of the present invention, a method of controlling the color display 5 includes providing a plurality of pixels 10 located on the substrate 8 in step 100. Each pixel 10 includes only three light-emitting sub-pixels 20 that each emits light of a different non-white color. The plurality of pixels 10 includes a first sub-set of first pixels 12 and a second sub-set of second pixels 14. The second pixels 14 have locations alternating with the first pixels 12. Each of the first and second pixels 12, 14 includes at least one first sub-pixel 20 emitting light of a common first color. The second pixels 14 includes at least one different sub-pixel 20 emitting light of a different color that is not emitted by any sub-pixel 20 of the first pixels 12. The light emitted by the sub-pixels 20 of the first pixels 12 defines a full-color gamut and the light emitted by the sub-pixels 20 of the second pixels 14 defines less than a full-color gamut.

In step 105, the controller 40 is provided having thin-film transistor circuits 9 connected to the sub-pixels 20 that converts the received image signal 42 to the display signal 44. The received image signal 42 is converted to the display signal 44 by receiving the image signal 42 in step 110 and converting the received image signal 42 to the display signal 44 in step 115. The display signal 44 is output to the color display 5 in step 120 and controls the light emitted by the sub-pixels 20 with the display signal 44 in step 125, causing the sub-pixels 20 to emit light in step 130.

Figure 6:
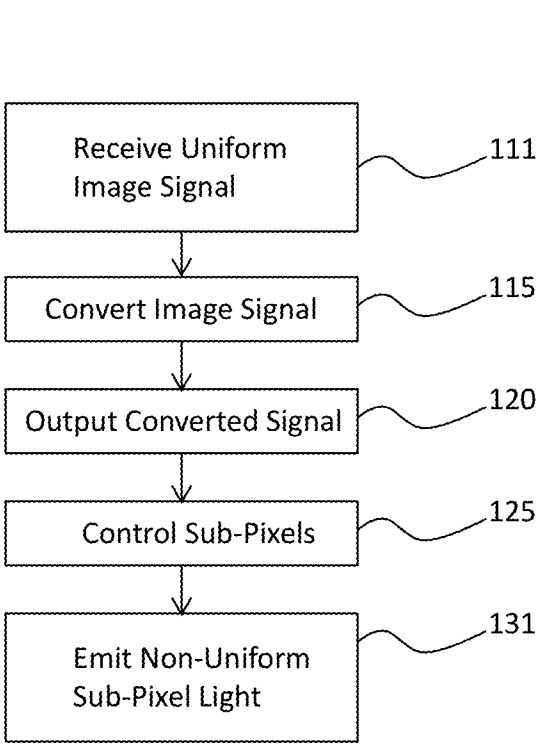
FIG. 6 is a flow diagram illustrating a method of the present invention.
Figure 14:
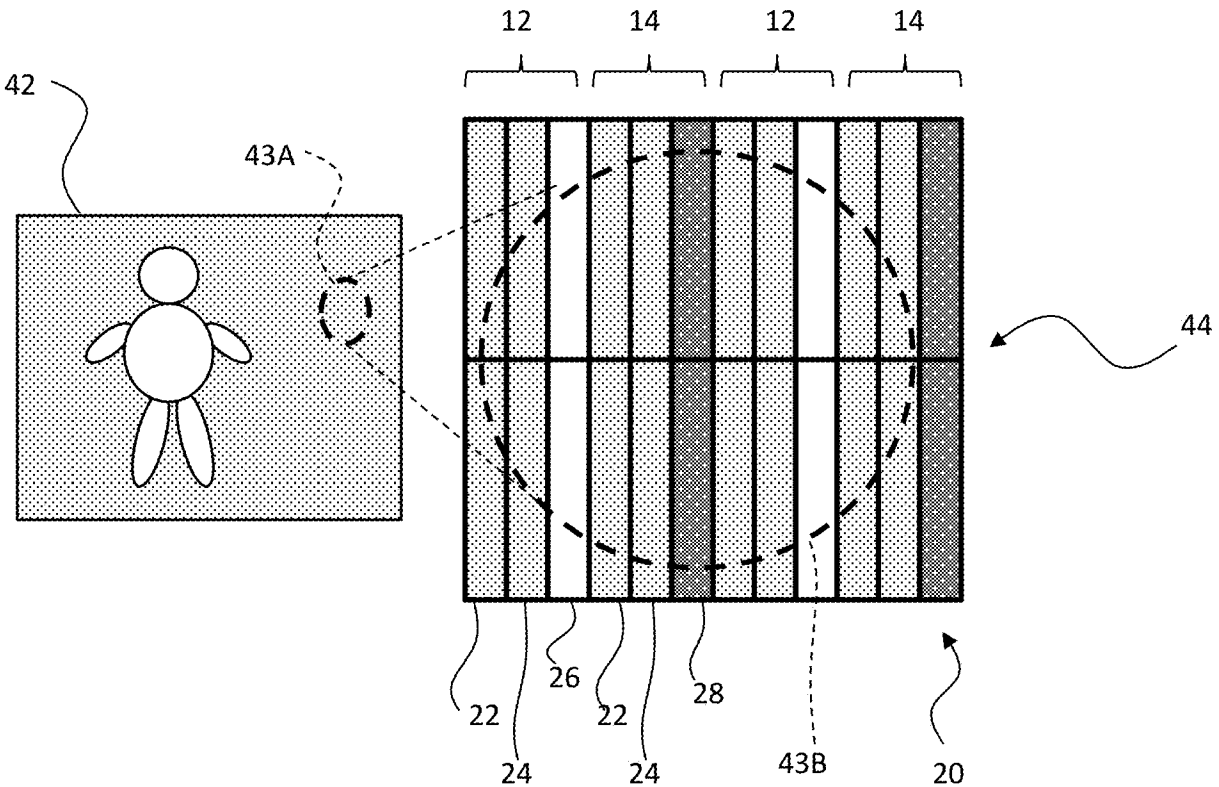
FIG. 14 is a schematic illustrating an embodiment of the present invention.

In a further method of the present invention and with reference to FIG. 6 and FIG. 14, the image signal 42 received in step 111 specifies a uniform image area 43A. The uniform image area 43A is an area within in an image signal 42 in which the image signal 42 is constant, for example a single color. The received image signal 42 is converted to the display signal 44 specifying a non-uniform pixel light emission area 43B in the pixels 12, 14 of the color display 5 corresponding to the uniform image area 43A in step 115. The converted display signal 44 is output in step 120 to the sub-pixels 20 that are then controlled in step 125 to emit non-uniform light in step 131. An image shown on the color display 5 has areas on the color display 5 corresponding to portions of the image. Thus, the uniform image area 43A in the image signal 42 has a corresponding display area 43B on the color display 5 in which the uniform image area 43A is displayed. The corresponding display area 43B displays the uniform image area 43A with a non-uniform signal. However, as discussed above, in an embodiment of the invention the non-uniform emitted signal has a sufficiently high resolution that it is perceived as a uniform signal by a human viewer.

Figure 7:
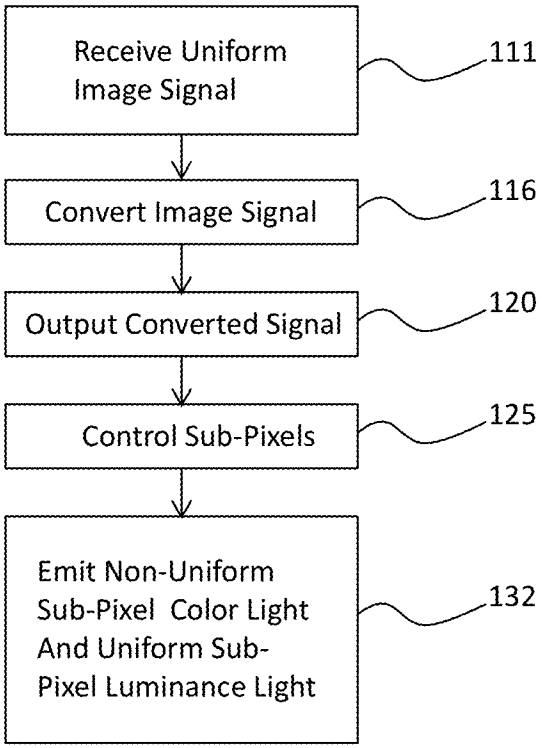
FIG. 7 is a flow diagram illustrating a method of the present invention.

In an embodiment of the present invention illustrated in FIG. 7, the display signal 44 includes a luminance signal and a color signal specifying the luminance and color light emitted from each pixel 12, 14. The uniform image signal 42 is received in step 111 and is converted to the display signal 44 specifying a non-uniform color signal and a substantially uniform pixel luminance signal in the pixels of the display corresponding to the image area in step 116. Referring again to FIG. 14, the green light-emitting second sub-pixel 24 carries a significant portion of the luminance signal and uniformly reproduces the uniform image area 43A of the image signal 42. The color signal is carried, in part, by the blue light-emitting third sub-pixel 26 and cyan light-emitting different sub-pixel 28. As shown, the blue light-emitting third sub-pixel 26 emits less (or no) light while the cyan different sub-pixel 28 emits more light. Alternatively, the blue light-emitting third sub-pixel 26 emits some light while the cyan different sub-pixel 28 emits a different amount of light. FIG. 14 corresponds to the embodiment of FIG. 1. The converted image signal is output in step 120 to the sub-pixels 20 that then controls the sub-pixels 20 in step 125 to emit non-uniform sub-pixel color light and uniform sub-pixel luminance light in step 132. However, as discussed above, in an embodiment of the invention the non-uniform emitted color signal has a sufficiently high resolution that it is perceived as a uniform color signal by a human viewer Thus in this embodiment of the present invention, first pixels 12 have red, green, and blue light-emitting first, second and third sub-pixels 22, 24, 26 and second pixels 14 have red, green, and cyan light-emitting first, second and different sub-pixels 22, 24, 28. The light output from the sub-pixels 20 of the first and second pixels 12, 14 are controlled in response to the image signal 42 specifying the uniform image area 43A so that the light emitted by the different sub-pixel 28 emitting cyan light is greater than the light emitted by the third sub-pixel 26 emitting blue light in the pixels 20 of the display corresponding to the uniform image area 43A.

This same method can be applied to the embodiment of FIG. 2 in which the red and yellow light-emitting sub-pixels are controlled similarly to the blue and cyan sub-pixels respectively. In this alternative embodiment of the present invention, first pixels 12 have red, green, and blue light-emitting first, second and third sub-pixels 22, 24, 26 and second pixels 14 have yellow, green, and blue light-emitting different, second, third sub-pixels 28, 24, 26. The light output from the sub-pixels 20 of the first and second pixels 12, 14 is controlled in response to the image signal 42 specifying the uniform image area 43A so that the light emitted by the different sub-pixel 28 emitting yellow light is greater than the light emitted by the first sub-pixel 22 emitting red light in the pixels 20 of the color display 5 corresponding to the uniform image area 43A.

In the embodiments of FIG. 3, the blue/cyan pairs of light-emitting sub-pixels 26, 29 are similarly controlled as are the red/yellow pairs of light-emitting sub-pixels 22, 28. In this embodiment of the present invention, first pixels 12 have red, green, and blue light-emitting first, second and third sub-pixels 22, 24, 26 and second pixels 14 have yellow, green, and cyan light-emitting different, second and second different sub-pixels 28, 24, 29. The light output from the sub-pixels 20 of the first and second pixels 12, 14 is controlled in response to the image signal 42 specifying the uniform image area 43A so that the light emitted by the second different sub-pixel 29 emitting cyan light is greater than the light emitted by the third sub-pixel 26 emitting blue light and so that the light emitted by the different sub-pixel 28 emitting yellow light is greater than the light emitted by the first sub-pixel 22 emitting red light in the pixels 20 of the color display 5 corresponding to the uniform image area 43A.

In FIG. 4, the third pixel 16 controls the yellow light-emitting different sub-pixel 28 but otherwise the sub-pixels are controlled as described. Thus, according to yet another method of the present invention, a third sub-set of third pixels 16 having locations alternating with the first and second pixels 12, 14 is provided. The third pixels 16 include at least one first sub-pixel 20 emitting light of the common first color and a second different sub-pixel 20 that emits light of a second different color that is not emitted by any of the sub-pixels 20 of either the first or second pixels 12, 14. In such an embodiment, the color display 5 includes first pixels 12 having red, green, and blue light-emitting sub-pixels 20, second pixels 14 having red, green, and cyan light-emitting sub-pixels 20, and third pixels 16 having yellow, green, and blue light-emitting sub-pixels 20. The light output from the sub-pixels 20 of the first second, and third pixels 12, 14, 16 in response to the image signal 42 specifying the uniform image area 43A is controlled so that the light output from the sub-pixel 20 emitting cyan light is greater than the light output from one or both of the sub-pixels 20 emitting blue light or the light output from the sub-pixel 20 emitting yellow light is greater than the light output from one or both of the sub-pixels 20 emitting red light in the pixels 10 of the color display 5 corresponding to the uniform image area 43A.

In an embodiment, the light output from the green second sub-pixels 24 of the first, second, and third pixels 12, 14, 16 corresponding to the uniform image area 43A is controlled to be substantially uniform. In one embodiment, therefore, the common first color is green and the first and second pixels 12, 14 each include a sub-pixel 20 emitting red light and a remaining sub-pixel. The image signal 42 specifying the uniform image area 43A is received and converted to the display signal 44 specifying a substantially uniform light output from the green second sub-pixels 24 of the first and second pixels 12, 14, a substantially uniform light output from the red first sub-pixels 22 of the first and second pixels 12, 14, and a non-uniform light output from the remaining sub-pixels of the color display 5 corresponding to the uniform image area 43A.

Alternatively, the common first color is green and the first and second pixels 12, 14 each include a sub-pixel emitting blue light and a remaining sub-pixel. The image signal 42 specifying a uniform image area is received and converted to the display signal 44 specifying a substantially uniform light output from the green second sub-pixels 24 of the first and second pixels 12, 14, a substantially uniform light output from the blue third sub-pixels 26 of the first and second pixels 12, 14, and a non-uniform light output from the remaining sub-pixels of the color display 5 corresponding to the uniform image area.

In yet another example, the common first color is green and the first and second pixels 12, 14 each include two remaining sub-pixels. The image signal 42 specifying the uniform image area 43A is received and converted to the display signal 44 specifying a substantially uniform light output from the green second sub-pixels 24 of the first and second pixels 12, 14 and a non-uniform light output from the remaining sub-pixels of the color display 5 corresponding to the uniform image area.

Some image signals 42 include saturated primary colors (for example red or blue) emitted by sub-pixels that are not present in every pixel, depending on the embodiment of the invention. In this case the saturated primary colors can only be reproduced by the sub-pixels that emit the colors and not as a combination of light emitted by other sub-pixels. Hence, the image signal 42 is converted by the controller 40 to the display signal 44 that controls the sub-pixels to emit non-uniform light of that color by preventing the sub-pixels that emit the different colors of light (e.g. yellow or cyan) from emitting light. Since the human visual system is not as responsive to the spatial frequencies of the color signal, in an embodiment the variation in color output is not perceptible to a human viewer. For less saturated primary color signals, some light emission from the different colors of light (for example cyan or yellow) can be used to improve display efficiency in combination with the saturated primary color light emitters, for example red or blue.

Other image signals 42 include colors that are not primaries such as cyan or yellow. If the non-primary different color can be reproduced from the other primaries (i.e. the different color is within the gamut defined by the light emitted from the first pixel 12 as illustrated in FIG. 8), the image signal 42 is converted by the controller 40 to the display signal 44 that controls the sub-pixels to emit the color from every pixel. In this case, some efficiency is gained since the second pixels 14 output the color more efficiently than the first sub-pixels 12. A higher spatial frequency for the color is also achieved. Alternatively, more energy can be saved by reducing the light output from the first pixel 12 primary color sub-pixels and increasing the light output from the different sub-pixel 28 in the second pixels 14, if desired, at the cost of spatial uniformity. If a color that is as saturated as the color display 5 is capable of producing is desired, only the first pixels 12 are used, with no consequent efficiency gain and a non-uniform spatial output.

If the non-primary different color cannot be reproduced from the other primaries (i.e. the different color is outside the gamut defined by the light emitted from the first pixel 12 as illustrated in FIG. 9), the image signal 42 is converted by the controller 40 to the display signal 44 that controls the sub-pixels to emit the color from the different pixel. In this case, not only is the gamut increased but some efficiency is gained since the second pixels 14 output the color more efficiently than the less-saturated approximation of the color light output from first sub-pixels 12. If a less-saturated color that is within the gamut defined by the light output by the first pixels 12 is desired, light output from both the first and second pixels 12, 14 can be used to improve spatial uniformity with some efficiency improvement. Alternatively, more light can be output from the second pixel 14 and less light output from the first pixel 12, thereby reducing the spatial uniformity but increasing the efficiency.

A light output effectively equal to zero is a light that is not readily perceptible to a human observer, while a light output that is substantially greater than zero is a light that is readily perceptible to a human observer. Thus, in other embodiments, the received image signal 42 is converted to the display signal 44 specifying light emission effectively equal to zero for a corresponding first pixel 12 and light emission substantially greater than zero for a corresponding second pixel 14 in the uniform image area 43B of the color display 5. In another embodiment, the received image signal 42 is converted to the display signal 44 specifying light emission less than the second pixel light output for a corresponding first pixel 12 and light emission substantially greater than zero for a corresponding second pixel 14 in the uniform image area 43B of the color display 5. The light emission can be either saturated or unsaturated.

The invention has been described in detail with particular reference to certain embodiments thereof, but it will be understood that variations and modifications can be effected within the spirit and scope of the invention.

PARTS LIST 1 color display system
5 color display
8 substrate
9 thin-film transistor circuits
10 pixel
11 pixel
12 first pixel
14 second pixel
16 third pixel
18 extended-color-gamut pixel
18A extended-color-gamut pixel
18B extended-color-gamut pixel
20 sub-pixel
22 first sub-pixel
24 second sub-pixel
26 third sub-pixel
28 different sub-pixel
29 second different sub-pixel
40 controller
41 controller
42 image signal
43A uniform area in image signal
43B uniform area in display signal
44 display signal
45 display signal
50 red light-emitting sub-pixel
52 green light-emitting sub-pixel
54 blue light-emitting sub-pixel
56 yellow light-emitting sub-pixel

PARTS LIST CONT'D 58 cyan light-emitting sub-pixel
60 first color gamut
62 extended color gamut
70 red point
72 green point
74 blue point
76 cyan point
77 cyan point
78 yellow point
79 yellow point
80 white point
90 locus of saturated colors
100 provide array of pixels step
105 provide controller step
110 receive image signal step

111 receive non-uniform image signal step
115 convert image signal step
116 convert luminance and color signal step
120 output converted signal step
125 control sub-pixels step
130 emit sub-pixel light step
131 emit non-uniform sub-pixel light step
132 emit non-uniform sub-pixel color light and uniform sub-pixel luminance light step

The invention claimed is:

1. A color display, comprising:

a substrate;

a plurality of pixels located on the substrate, each pixel including only three light-emitting sub-pixels that each emit light of a different non-white color, the plurality of pixels including only a first sub-set of first pixels and a second sub-set of second pixels, the second pixels having locations alternating with the first pixels, each of the first and second pixels including at least one first sub-pixel emitting light of a common first color, and the second pixels including at least one different sub-pixel emitting light of a different color that is not emitted by any sub-pixel of the first pixels; and wherein the light emitted by the sub-pixels of the first pixels defines a full-color gamut, the light emitted by the sub-pixels of the second pixels defines less than a full-color gamut, and each sub-pixel is included in one of the plurality of pixels.

2. The color display according to claim 1, wherein each of the first and second pixels include at least one second sub-pixel emitting light of a common second color different from the common first color.

3. The color display according to claim 2, wherein the common first color is green, the common second color is red, the first pixel includes a third sub-pixel that emits blue light, and the different color is cyan.

4. The color display according to claim 2, wherein the common first color is green, the common second color is blue, the first pixel includes a third sub-pixel that emits red light, and the different color is yellow.

5. The color display according to claim 1, wherein the second pixels include a second different sub-pixel that emits light of a second different color that is not emitted by any sub-pixel of the first pixels.

6. The color display according to claim 5, wherein the common first color is green, the different color is yellow, and the second different color is cyan.

7. The color display according to claim 5, wherein the first pixel includes sub-pixels that emit green, red, and blue light, and the second pixel includes sub-pixels that emit yellow, green, and cyan light.

8. The color display according to claim 1, wherein the first pixel includes a sub-pixel that emits a color of light that is complementary to the color of light emitted by the different sub-pixel of the second pixel.

9. The color display according to claim 1, wherein the plurality of pixels forms a two-dimensional array of pixels.

10. The color display according to claim 9, wherein every second pixel in one or both dimensions of the array of pixels is a first pixel and every other pixel in one or both dimensions of the array of pixels is a second pixel.

11. The color display according to claim 9, wherein every fourth pixel in one or both dimensions of the array of pixels is a second pixel and the remaining pixels are first pixels.

12. The color display according to claim 1, wherein at least one sub-pixel of at least one pixel of the plurality of pixels is a different size or shape than another sub-pixel of the one pixel or another of the plurality of pixels.

13. The color display according to claim 1, wherein the different color is within the full-color gamut.

14. The color display according to claim 1, wherein the different color is not within the full-color gamut.

15. The color display according to claim 1, wherein the sub-pixel of the second pixels that emits light of the different color has a greater luminous efficacy than the sub-pixel of the first pixels that emits light that is not emitted by any of the sub-pixels of the second pixels.

16. A color display, comprising:

a substrate;

a plurality of pixels located on the substrate, each pixel including only three light-emitting sub-pixels that each emit light of a different non-white color, the plurality of pixels including a first sub-set of first pixels and a second sub-set of second pixels, the second pixels having locations alternating with the first pixels, each of the first and second pixels including at least one first sub-pixel emitting light of a common first color, and the second pixels including at least one different sub-pixel emitting light of a different color that is not emitted by any sub-pixel of the first pixels; and wherein the light emitted by the sub-pixels of the first pixels defines a full-color gamut, and the light emitted by the sub-pixels of the second pixels defines less than a full-color gamut;

the plurality of pixels includes a third sub-set of third pixels having locations alternating with the first and second pixels;

the third pixels include at least one first sub-pixel emitting light of the common first color; and the third pixel includes a second different sub-pixel that emits light of a second different color that is not emitted by any of the sub-pixels of either the first or second pixels.

17. The color display according to claim 16, wherein:

each of the first and second pixels include at least one second sub-pixel emitting light of a common second color different from the common first color; and each of the first and third pixels include at least one sub-pixel emitting light of a common third color different from the common first color and different from the common second color.

18. The color display according to claim 17, wherein the common first color is green, the common second color is red, the common third color is blue, the different color is cyan, and the second different color is yellow.

19. The color display according to claim 17, wherein the plurality of pixels forms a two-dimensional array of pixels and every second pixel in one or both dimensions of the array of pixels is a first pixel, every fourth pixel in one or both dimensions of the array is a second pixel, and every fourth pixel in one or both dimensions of the array is a third pixel.

20. The color display according to claim 16, wherein the first pixel includes a sub-pixel that emits a color of light that is complementary to the different color of light emitted by a sub-pixel of the second pixel and the first pixel includes a sub-pixel that emits a color of light that is complementary to the second different color of light emitted by a sub-pixel of the third pixel.

21. A color display, comprising:

a substrate;

a plurality of pixels located on the substrate, each pixel including only three light-emitting sub-pixels that each emit light of a different non-white color, the plurality of pixels including a first sub-set of first pixels and a second sub-set of second pixels, the second pixels having locations alternating with the first pixels, each of the first and second pixels including at least one first sub-pixel emitting light of a common first color, and the second pixels including at least one different sub-pixel emitting light of a different color that is not emitted by any sub-pixel of the first pixels;

wherein the light emitted by the sub-pixels of the first pixels defines a full-color gamut, and the light emitted by the sub-pixels of the second pixels defines less than a full-color gamut; and a display signal having a luminance signal and a color signal specifying the light emitted by each pixel and wherein the luminance signal emitted from the first or the second pixels is not resolvable by a user viewing the color display and the color signal emitted from each pair of pixels is not resolvable by a user viewing the color display within a desired viewing distance range.

22. The color display according to claim 21, wherein the luminance signal emitted from only second pixels is resolvable by a user viewing the color display within a desired viewing distance range.

* * * * *